US011137168B2

(12) United States Patent
Mori et al.

(10) Patent No.: US 11,137,168 B2
(45) Date of Patent: Oct. 5, 2021

(54) COMBUSTION DEVICE

(71) Applicant: NORITZ CORPORATION, Kobe (JP)

(72) Inventors: Masahiro Mori, Kakogawa (JP); Tomoki Kishimoto, Ono (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 16/967,700

(22) PCT Filed: Feb. 12, 2019

(86) PCT No.: PCT/JP2019/004804

§ 371 (c)(1),
(2) Date: Aug. 5, 2020

(87) PCT Pub. No.: WO2019/159877

PCT Pub. Date: Aug. 22, 2019

(65) Prior Publication Data

US 2021/0033308 A1 Feb. 4, 2021

(30) Foreign Application Priority Data

Feb. 19, 2018 (JP) ..... JP2018-026750

(51) Int. Cl.

| | |
|---|---|
| ***F24H 9/20*** | (2006.01) |
| ***F24H 1/00*** | (2006.01) |
| ***F24H 1/18*** | (2006.01) |
| ***F24H 9/00*** | (2006.01) |
| ***F23N 5/24*** | (2006.01) |

(52) U.S. Cl.
CPC ..... *F24H 9/2035* (2013.01); *F23N 5/242* (2013.01); *F24H 1/0027* (2013.01); *F24H 1/186* (2013.01); *F24H 9/0005* (2013.01)

(58) Field of Classification Search
None
See application file for complete search history.

(56) References Cited

U.S. PATENT DOCUMENTS

2008/0092826 A1 4/2008 Kishimoto et al.

FOREIGN PATENT DOCUMENTS

JP 4877604 B2 2/2012
JP 2017116176 A 6/2017

*Primary Examiner* — Jason Lau
(74) *Attorney, Agent, or Firm* — Studebaker & Brackett PC

(57) ABSTRACT

A combustion device includes: a gas proportional valve; a control portion; a driving circuit; and a monitoring circuit. The monitoring circuit includes: a voltage generating portion configured to generate monitoring voltages corresponding to a driving current; and a branch output portion configured to output the monitoring voltages to a plurality of terminals of the control portion. When a voltage difference between the monitoring voltages input to the plurality of terminals is a determination reference value or more, the control portion determines that there is a failure of the monitoring circuit. When the voltage difference between the monitoring voltages is less than the determination reference value, and at least one of the monitoring voltages does not fall within a predetermined normal range while the gas proportional valve is controlled to become a predetermined state, the control portion determines that there is the failure of the monitoring circuit.

8 Claims, 2 Drawing Sheets

COMBUSTION DEVICE

TECHNICAL FIELD

The present invention relates to a combustion device, such as a gas water heater.

BACKGROUND ART

In combustion devices, such as gas water heaters, a gas proportional valve is provided at a gas supply passage to supply desired gas to a burner. The gas proportional valve controls the amount of supply gas by changing a valve opening degree depending on the magnitude of a driving current. When a large driving current flows through the gas proportional valve for some reason, this causes problems, such as an abnormally high temperature of hot water supplied. Therefore, a monitoring circuit configured to monitor the driving current for the gas proportional valve is conventionally provided.

PTL 1 describes a combustion control device including a proportional valve current detecting circuit to detect the opening degree of the gas proportional valve.

PTL 2 describes a gas combustion device including a driving current monitoring circuit configured to output to a control portion a monitoring voltage signal corresponding to a current value of the driving current for the gas proportional valve.

CITATION LIST

Patent Literature

PTL 1: Japanese Patent No. 4877604

PTL 2: Japanese Laid-Open Patent Application Publication No. 2017-116176

SUMMARY OF INVENTION

Technical Problem

As described above, when the monitoring circuit configured to monitor the driving current for the gas proportional valve is included, in further consideration of safety, it is desired to detect a failure of the monitoring circuit as surely as possible.

The present invention was made to solve the above problems, and an object of the present invention is to provide a combustion device capable of detecting a failure of a monitoring circuit as surely as possible, the monitoring circuit being configured to monitor a driving current for a gas proportional valve.

Solution to Problem

To achieve the above object, a combustion device according to one aspect of the present invention is a combustion device including: a gas proportional valve configured to adjust an amount of gas supplied to a combustor; a control portion configured to output an opening degree signal that controls the gas proportional valve; a driving circuit configured to supply a driving current corresponding to the opening degree signal to the gas proportional valve; and a monitoring circuit configured to generate monitoring voltages corresponding to the driving current and output the monitoring voltages to the control portion. The monitoring circuit includes: a voltage generating portion configured to generate the monitoring voltages corresponding to the driving current; and a branch output portion configured to output the monitoring voltages, generated by the voltage generating portion, to two terminals of the control portion through two branch lines respectively connected to the two terminals. The control portion performs a first determination process in which the control portion compares the monitoring voltages respectively input to the two terminals with each other, and when a voltage difference between the monitoring voltages is a determination reference value or more, the control portion determines that there is a failure of the monitoring circuit, and a second determination process in which when the voltage difference between the monitoring voltages is less than the determination reference value, and at least one of the monitoring voltages does not fall within a predetermined normal range while the gas proportional valve is controlled to become a predetermined state, the control portion determines that there is the failure of the monitoring circuit.

Moreover, a combustion device according to another aspect of the present invention is a combustion device including: a gas proportional valve configured to adjust an amount of gas supplied to a combustor; a control portion configured to output an opening degree signal that controls the gas proportional valve; a driving circuit configured to supply a driving current corresponding to the opening degree signal to the gas proportional valve; and a monitoring circuit configured to generate monitoring voltages corresponding to the driving current and output the monitoring voltages to the control portion. The monitoring circuit includes: a voltage generating portion configured to generate the monitoring voltages corresponding to the driving current; and a branch output portion configured to output the monitoring voltages, generated by the voltage generating portion, to a plurality of terminals of the control portion through a plurality of branch lines respectively connected to the plurality of terminals. The control portion performs a first determination process in which the control portion compares the monitoring voltages respectively input to the plurality of terminals with each other, and when a maximum voltage difference between the monitoring voltages is a determination reference value or more, the control portion determines that there is a failure of the monitoring circuit, and a second determination process in which when the maximum voltage difference between the monitoring voltages is less than the determination reference value, and at least one of the monitoring voltages does not fall within a predetermined normal range while the gas proportional valve is controlled to become a predetermined state, the control portion determines that there is the failure of the monitoring circuit.

According to the above configuration of the combustion device, when it is determined by the first determination process that there is the failure of the monitoring circuit, the failure of the monitoring circuit may be a failure of the branch output portion. When it is determined by the second determination process that there is the failure of the monitoring circuit, the failure of the monitoring circuit may be a failure of the voltage generating portion. With this, the failure of the monitoring circuit configured to monitor the driving current of the gas proportional valve can be detected as surely as possible.

The control portion may perform the second determination process by using a first predetermined range as the normal range while the gas proportional valve is controlled to become a closed state. According to this configuration, the second determination process can be performed while the combustion operation of the combustor is not performed.

The control portion may perform the second determination process by using a second predetermined range as the normal range while an opening degree of the gas proportional valve is controlled to become a predetermined opening degree immediately before ignition of the combustor or in an initial stage of the ignition of the combustor. According to this configuration, the second determination process can be performed immediately before the combustion operation of the combustor or in an initial stage of the combustion operation of the combustor.

The control portion may be constituted by a plurality of microcontrollers that communicate with each other, and the terminals may be respectively included in the microcontrollers.

Advantageous Effects of Invention

The present invention is configured as above and has an effect of being able to provide the combustion device capable of detecting the failure of the monitoring circuit as surely as possible, the monitoring circuit being configured to monitor the driving current of the gas proportional valve.

DESCRIPTION OF EMBODIMENTS

Hereinafter, a preferred embodiment will be described with reference to the drawings. It should be noted that the present invention is not limited to the following embodiment.

EMBODIMENT

Figure 1:
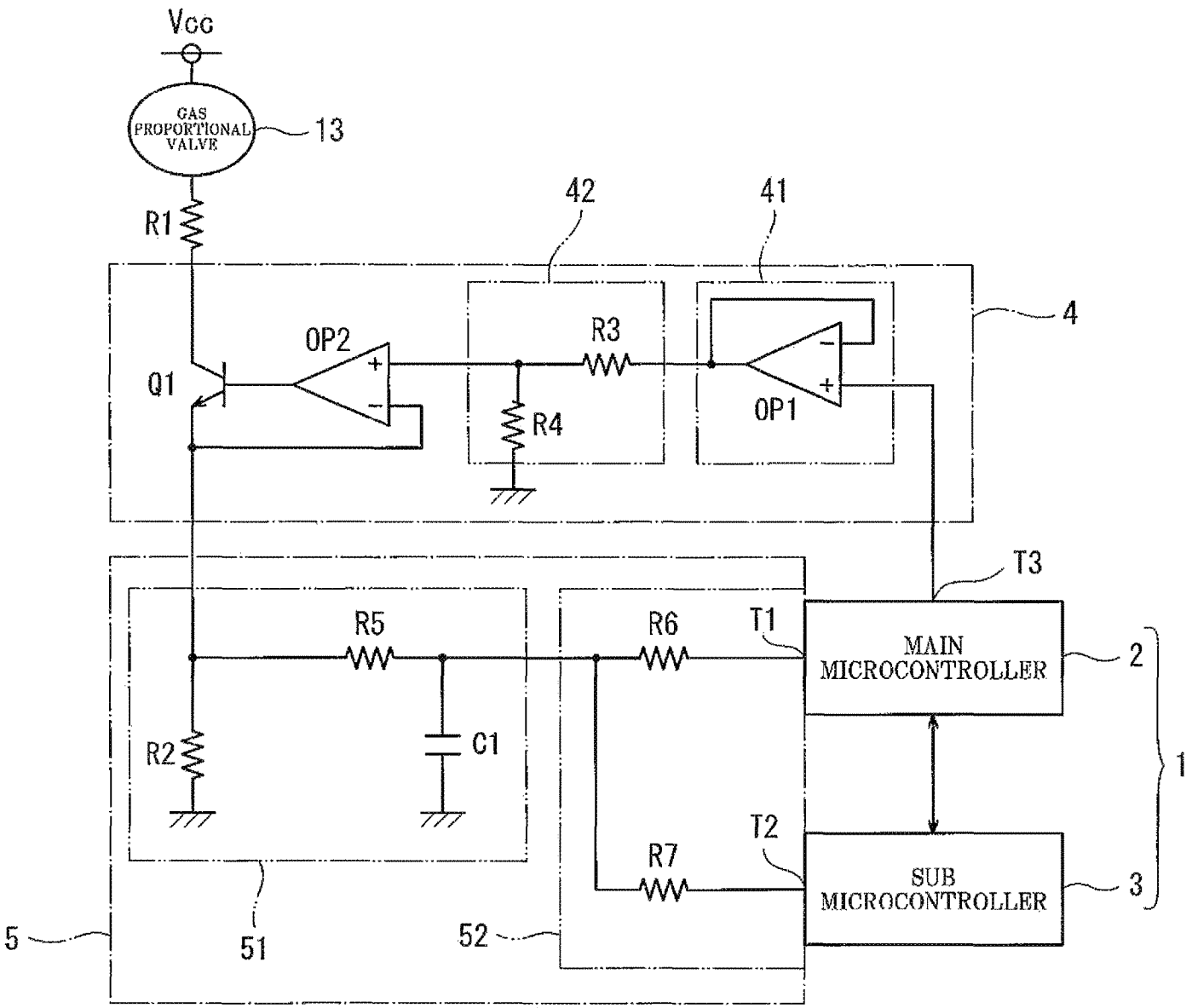
FIG. 1 is a circuit diagram showing examples of a driving circuit, a monitoring circuit, etc. for a gas proportional valve included in a combustion device of the present embodiment.
Figure 2:
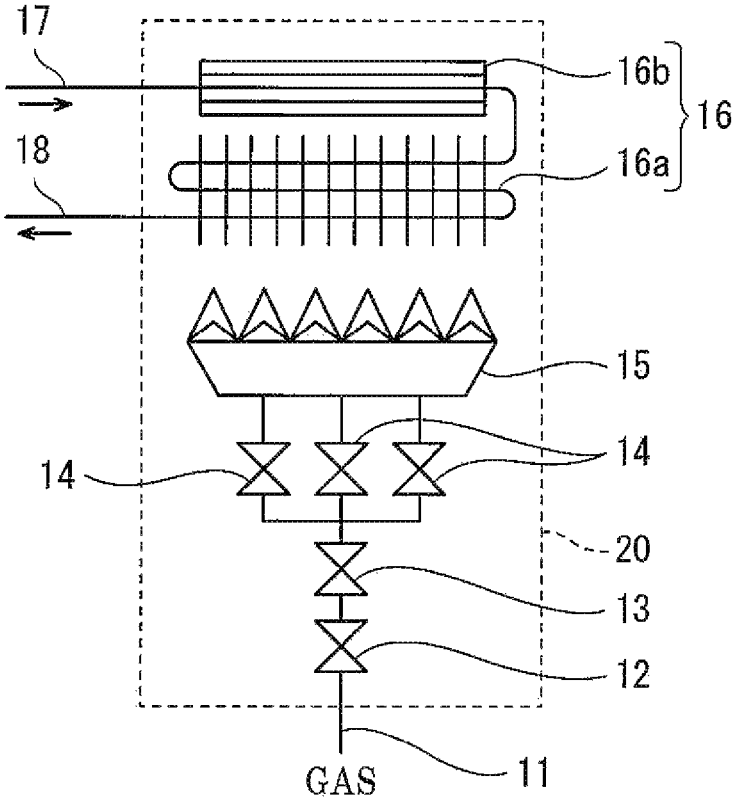
FIG. 2 is a schematic diagram showing examples of major components of the combustion device of the present embodiment.

FIG. 1 is a circuit diagram showing examples of a driving circuit, a monitoring circuit, etc. for a gas proportional valve included in a combustion device of the present embodiment. FIG. 2 is a schematic diagram showing examples of major components of the combustion device of the present embodiment.

The combustion device of the present embodiment is, for example, a gas water heater. As shown in FIG. 2, a can body (metal container) 20 accommodates: a heat exchanger 16 constituted by a primary heat exchanger 16*a* and a secondary heat exchanger 16*b*; a burner (combustor) 15 configured to heat the heat exchanger 16; capacity switching electromagnetic valves 14; a gas proportional valve 13; and an original gas electromagnetic valve 12.

The heat exchanger 16 is constituted by the primary heat exchanger 16*a* and the secondary heat exchanger 16*b* configured to recover latent heat. One of ends of a water inflow passage 17 is connected to an inflow side of the secondary heat exchanger 16*b*. Although not shown, the other end of the water inflow passage 17 is connected to waterworks. Water flows through the water inflow passage 17 into the secondary heat exchanger 16*b*. One of ends of a hot water outflow passage 18 is connected to an outflow side of the primary heat exchanger 16*a*. Although the other end of the hot water outflow passage 18 is not shown, for example, hot water flowing out from the other end of the hot water outflow passage 18 is adjusted in temperature by being mixed with water flowing into the hot water outflow passage 18 through a branch passage extending from the water inflow passage 17, and then, the water flows through an external pipe and flows out from a hot water tap, such as a faucet. It should be noted that the heat exchanger 16 may be constituted by a single heat exchanger connected between the water inflow passage 17 and the hot water outflow passage 18.

The gas introduced from a gas supply source (not shown) through a gas pipe 11 flows through the open-state original gas electromagnetic valve 12, the open-state gas proportional valve 13, and the open-state capacity switching electromagnetic valves 14 to be supplied to and combusted in the burner 15. The original gas electromagnetic valve 12 and the capacity switching electromagnetic valves 14 are on-off control electromagnetic valves. A plurality of capacity switching electromagnetic valves 14 are provided so as to be able switch the number of combustion tubes, which are combusting, of the burner 15 in several stages. The gas proportional valve 13 is a proportional control electromagnetic valve and can adjust an opening degree thereof to adjust a flow rate of gas to be supplied to the burner 15.

Control of opening and closing of the original gas electromagnetic valve 12 and the capacity switching electromagnetic valves 14 and control of the opening degree of the gas proportional valve 13 are performed by a main microcontroller 2 (hereinafter referred to as a "main MC 2") of a control portion 1 shown in FIG. 1.

The control portion 1 included in the combustion device is constituted by the main MC 2 and a sub microcontroller 3 (hereinafter referred to as a "sub MC 3") which are connected to each other so as to be able to communicate with each other. In the present embodiment, the main MC 2 controls the entire combustion device.

Next, a circuit related to the gas proportional valve 13 will be described. As shown in FIG. 1, the gas proportional valve 13, a resistor R1, a driving transistor Q1, and a resistor R2 are connected between a power supply line Vcc of 15V and a ground line in this order from the power supply line Vcc side.

Regarding the gas proportional valve 13, the combustion device of the present embodiment includes a driving circuit 4 and a monitoring circuit 5. The driving circuit 4 supplies to the gas proportional valve 13 a driving current corresponding to an opening degree signal (analog signal) of the gas proportional valve 13, the opening degree signal being output from an opening degree signal output terminal (analog output port) T3 of the main MC 2. The monitoring circuit 5 generates monitoring voltages (analog signals) corresponding to a current value of the driving current of the gas proportional valve 13 and outputs the monitoring voltages to a monitoring voltage input terminal (analog input port) T1 of the main MC 2 and a monitoring voltage input terminal (analog input port) T2 of the sub MC 3.

The driving circuit 4 is constituted by a constant current circuit configured to supply the driving current corresponding to the opening degree signal to the gas proportional valve 13. The constant current circuit includes a voltage follower 41, a voltage dividing circuit 42, an operational amplifier OP2, and the driving transistor Q1. The voltage follower 41 includes an operational amplifier OP1 and performs impedance conversion of the opening degree signal. The voltage dividing circuit 42 divides the converted opening degree signal by a resistor R3 and a resistor R4 and outputs a reference voltage. The reference voltage is input to a non-inversion input terminal of the operational amplifier OP2. The driving transistor Q1 is of an NPN type and is connected to an output of the operational amplifier OP2. A base of the driving transistor Q1 is connected to the output of the operational amplifier OP2, and an emitter of the driving transistor Q1 is connected to an inversion input terminal of the operational amplifier OP2. With this, a negative feedback circuit is constituted. Therefore, an emitter voltage becomes equal to the reference voltage by virtual short of the operational amplifier OP2, and a constant current is supplied as the driving current to the gas proportional valve 13. The constant current is output from the emitter of the driving transistor Q1.

The monitoring circuit 5 includes a voltage generating portion 51 and a branch output portion 52 including a plurality of branch lines. The voltage generating portion 51 includes the load resistor R2 connected to the emitter of the driving transistor Q1. When the driving current flowing through the gas proportional valve 13 flows through the load resistor R2, a voltage corresponding to the driving current is generated at the load resistor R2. The voltage of the load resistor R2 is taken out through a low pass filter constituted by a resistor R5 and a capacitor C1. The voltage (output voltage of the voltage generating portion 51) taken out through the low pass filter is supplied to the branch output portion 52 to be applied to the monitoring voltage input terminal T1 of the main MC 2 through the branch line including a resistor R6 and also applied to the monitoring voltage input terminal T2 of the sub MC 3 through the branch line including a resistor R7.

Next, the operation of the combustion device of the present embodiment, a method of diagnosing a failure of the combustion device of the present embodiment, and the like will be described.

When performing a combustion operation of the combustion device, i.e., when performing a hot water supply operation of the gas water heater, the main MC 2 calculates the amount of fuel gas supplied to the burner 15 based on a set temperature input from, for example, an operation remote controller (not shown) and detected values of a temperature sensor (not shown) and the like provided at the water inflow passage 17 or the hot water outflow passage 18, and then outputs the opening degree signal of the gas proportional valve 13 from the output terminal T3 in accordance with the calculated amount of fuel gas.

During the combustion of the burner 15, the main MC 2 determines, for example, whether or not the voltage input to the input terminal T1 is a predetermined allowable value or less. When a time during which the voltage exceeds the allowable value continues for a predetermined time, the main MC 2 determines that there is a failure (for example, an ON failure of the driving transistor Q1) of the driving circuit 4. Then, the main MC 2 performs a predetermined safety process (for example, control of closing the original gas electromagnetic valve 12 and the capacity switching electromagnetic valves 14).

The main MC 2 diagnoses the failure of the monitoring circuit 5 based on the voltage value of the input terminal T1 and the voltage value of the input terminal T2 of the sub MC 3. The sub MC 3 transmits to the main MC 2 information of the voltage value applied to the input terminal T2. The following will describe a method of diagnosing the failure of the monitoring circuit 5.

To diagnose the failure of the monitoring circuit 5, the main MC 2 performs a first determination process and a second determination process.

First, in the first determination process, the main MC 2 compares the voltage value of the terminal T1 with the voltage value of the terminal T2, and when a difference between these voltage values is a predetermined determination reference value or more, the main MC 2 determines that there is the failure of the monitoring circuit 5. In this case, there may be the failure of the branch output portion 52, such as an open failure in which the terminal T1 or T2 floats from a transmission line by a solder crack or the like or an open failure in which the resistor R6 or R7 floats from a transmission line. The first determination process can be performed both while the combustion operation of the burner 15 is performed and while the combustion operation of the burner 15 is not performed, i.e., the first determination process can be performed at all times regardless of the operating state of the gas proportional valve 13.

Next, in the second determination process, when the difference between the voltage value of the terminal T1 and the voltage value of the terminal T2 is less than the determination reference value, and one of the voltage values of the terminals T1 and T2 does not fall within a normal range while the gas proportional valve 13 is controlled to become a predetermined state, the main MC 2 determines that there is the failure of the monitoring circuit 5. In this case, there may be the failure of the voltage generating portion 51, such as an open failure in which the resistor R5 floats from a transmission line. Regarding the second determination process, there are first and second cases as below.

In the first case, when the difference between the voltage value of the terminal T1 and the voltage value of the terminal T2 is less than the determination reference value, and one of the voltage values of the terminals T1 and T2 does not fall within a first predetermined range (normal range) while the burner 15 does not perform the combustion operation, i.e., while the gas proportional valve 13 is not operating (the gas proportional valve 13 is in a closed state), the main MC 2 determines that there is the failure of the monitoring circuit 5 (voltage generating portion 51).

For example, when the monitoring circuit 5 is normal, and the gas proportional valve 13 is not operating, i.e., the gas proportional valve 13 is in a closed state, the driving current does not flow through the gas proportional valve 13, and the applied voltages of the terminals T1 and T2 are 0V. However, when the open failure of the resistor R5 of the voltage generating portion 51 occurs, the voltage values of the terminals T1 and T2 are uniquely determined by input impedance and voltages in the MCs 2 and 3 and do not become 0V. Moreover, when the branch output portion 52 is normal, the applied voltages of the terminals T1 and T2 are equal to each other.

Therefore, when the gas proportional valve 13 is in a closed state, and the applied voltages of the terminals T1 and T2 are equal to each other but are not 0V, the main MC 2 can determine that there is the failure of the voltage generating portion 51 as described above. The above-described first predetermined range can be set to a range of 0V to substantially 0V (for example, a range of 0V to 0.5V).

Next, the second case will be described. When performing the combustion operation of the burner 15 in the combustion device of the present embodiment, an operation check of the gas proportional valve 13 is performed immediately before the ignition of the burner 15 is performed. In the operation check, with the electromagnetic valves 12 and 14 closed, the gas proportional valve 13 is made to become a fully open state (predetermined opening degree A) and then is closed. When an abnormality is found in the operation check, the combustion operation is stopped. When no abnormality is found in the operation check, the electromagnetic valves 12 and 14 are opened, and the opening degree of the gas proportional valve 13 is set to a predetermined opening degree B that is slightly smaller than the opening degree A. Then, the ignition of the burner 15 is performed. Therefore, the opening degree of the gas proportional valve 13 is set to the predetermined opening degree A immediately before the ignition of the burner 15 is performed, and the opening degree of the gas proportional valve 13 is set to the predetermined opening degree B in an initial stage of the ignition of the burner 15.

Then, in the second case, the main MC 2 prestores the normal range (second predetermined range) of the monitoring voltage corresponding to the driving current flowing through the gas proportional valve 13 when the gas proportional valve 13 is set to the opening degree A (full open) immediately before the ignition of the burner 15 or the opening degree B in the initial stage of the ignition. Needless to say, the driving current and the normal range (second predetermined range) of the monitoring voltage are different between the opening degree A (full open) and the opening degree B. For example, the normal range (second predetermined range) of the monitoring voltage in the case of the opening degree A (full open) is a range of 4.5±0.2V, the normal range (second predetermined range) of the monitoring voltage in the case of the opening degree B is a range slightly lower in level than the range in the case of the opening degree A.

Then, when the difference between the voltage value of the terminal T1 and the voltage value of the terminal T2 is less than the determination reference value, and one of the voltage values of the terminals T1 and T2 does not fall within the corresponding second predetermined range (normal range) while the gas proportional valve 13 is set to the opening degree A (full open) immediately before the ignition of the burner 15 or while the gas proportional valve 13 is set to the opening degree B in the initial stage of the ignition of the burner 15, the main MC 2 determines that there is the failure of the monitoring circuit 5 (voltage generating portion 51).

The failure determination process in the second case may be performed in one or both of the case of the opening degree A (full open) and the case of the opening degree B.

As above, when the main MC 2 determines that there is the failure of the monitoring circuit 5, and the burner 15 is in a combustion state, the main MC 2 performs the predetermined safety process. To be specific, for example, the electromagnetic valves 12 and 14 and the gas proportional valve 13 are closed to stop the supply of the gas to the burner 15, and with this, the combustion operation is stopped. Moreover, when the main MC 2 determines that there is the failure of the monitoring circuit 5, and immediately before the combustion operation is performed, the combustion operation is canceled.

In the present embodiment, when it is determined through the first determination process that there is the failure of the monitoring circuit 5, the failure of the monitoring circuit 5 may be the failure of the branch output portion 52. Moreover, when it is determined through the second determination process that there is the failure of the monitoring circuit 5, the failure of the monitoring circuit 5 may be the failure of the voltage generating portion 51. With this, the failure of the monitoring circuit 5 configured to monitor the driving current of the gas proportional valve 13 can be detected as surely as possible.

In the present embodiment, the failure diagnosis of the monitoring circuit 5 is performed by the main MC 2. However, information of the voltage value of the terminal T1 may be transmitted from the main MC 2 to the sub MC 3, and the sub MC 3 may perform the failure diagnosis of the monitoring circuit 5. Moreover, both the main MC 2 and the sub MC 3 may perform the failure diagnosis of the monitoring circuit 5.

The control portion 1 is constituted by two MCs that are the main MC 2 and the sub MC 3 but may be constituted by a single MC.

In the present embodiment, two branch lines are provided as the branch output portion 52. However, three or more branch lines may be provided, and output terminals of the branch lines may be connected to terminals of the control portion 1. Then, the failure diagnosis (first and second determination processes) of the monitoring circuit 5 may be performed based on voltages (monitoring voltages) of the terminals. In this case, the first determination process is performed in such a manner that: the monitoring voltages input to the terminals of the control portion 1 are compared with each other; and when a maximum voltage difference between the monitoring voltages is a determination reference value or more, it is determined that there is the failure of the monitoring circuit. Moreover, the second determination process is performed in such a manner that when the maximum voltage difference between the monitoring voltages input to the terminals is less than the determination reference value, and at least one of the monitoring voltages does not fall within the normal range while the gas proportional valve 13 is controlled to become a predetermined state, it is determined that there is the failure of the monitoring circuit. Furthermore, when a plurality of terminals to which the monitoring voltages are input are respectively included in a plurality of MCs which can communicate with each other, communication is performed among the MCs to compare the monitoring voltages input to the terminals with each other. Moreover, a plurality of terminals to which the monitoring voltages are input may be included in the control portion 1 constituted by a single MC.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

INDUSTRIAL APPLICABILITY

The present invention is useful as, for example, a combustion device capable of detecting a failure of a monitoring circuit as surely as possible, the monitoring circuit being configured to monitor a driving current of a gas proportional valve.

REFERENCE SIGNS LIST

1 control portion
2 main microcontroller
3 sub microcontroller
4 driving circuit
5 monitoring circuit
51 voltage generating portion
52 branch output portion
13 gas proportional valve
15 burner

The invention claimed is:

1. A combustion device comprising:

a gas proportional valve configured to adjust an amount of gas supplied to a combustor;

a control portion configured to output an opening degree signal that controls the gas proportional valve;

a driving circuit configured to supply a driving current corresponding to the opening degree signal to the gas proportional valve; and a monitoring circuit configured to generate monitoring voltages corresponding to the driving current and output the monitoring voltages to the control portion, wherein:

the monitoring circuit includes a voltage generating portion configured to generate the monitoring voltages corresponding to the driving current and a branch output portion configured to output the monitoring voltages, generated by the voltage generating portion, to two terminals of the control portion through two branch lines respectively connected to the two terminals; and the control portion performs a first determination process in which the control portion compares the monitoring voltages respectively input to the two terminals with each other, and when a voltage difference between the monitoring voltages is a determination reference value or more, the control portion determines that there is a failure of the monitoring circuit, and a second determination process in which when the voltage difference between the monitoring voltages is less than the determination reference value, and at least one of the monitoring voltages does not fall within a predetermined normal range while the gas proportional valve is controlled to become a predetermined state, the control portion determines that there is the failure of the monitoring circuit.

2. A combustion device comprising:

a gas proportional valve configured to adjust an amount of gas supplied to a combustor;

a control portion configured to output an opening degree signal that controls the gas proportional valve;

a driving circuit configured to supply a driving current corresponding to the opening degree signal to the gas proportional valve; and a monitoring circuit configured to generate monitoring voltages corresponding to the driving current and output the monitoring voltages to the control portion, wherein:

the monitoring circuit includes a voltage generating portion configured to generate the monitoring voltages corresponding to the driving current and a branch output portion configured to output the monitoring voltages, generated by the voltage generating portion, to a plurality of terminals of the control portion through a plurality of branch lines respectively connected to the plurality of terminals; and the control portion performs a first determination process in which the control portion compares the monitoring voltages respectively input to the plurality of terminals with each other, and when a maximum voltage difference between the monitoring voltages is a determination reference value or more, the control portion determines that there is a failure of the monitoring circuit, and a second determination process in which when the maximum voltage difference between the monitoring voltages is less than the determination reference value, and at least one of the monitoring voltages does not fall within a predetermined normal range while the gas proportional valve is controlled to become a predetermined state, the control portion determines that there is the failure of the monitoring circuit.

3. The combustion device according to claim 1, wherein the control portion performs the second determination process by using a first predetermined range as the normal range while the gas proportional valve is controlled to become a closed state.

4. The combustion device according to claim 1, wherein the control portion performs the second determination process by using a second predetermined range as the normal range while an opening degree of the gas proportional valve is controlled to become a predetermined opening degree immediately before ignition of the combustor or in an initial stage of the ignition of the combustor.

5. The combustion device according to claim 1, wherein:

the control portion is constituted by a plurality of microcontrollers that communicate with each other; and the terminals are respectively included in the microcontrollers.

6. The combustion device according to claim 2, wherein the control portion performs the second determination process by using a first predetermined range as the normal range while the gas proportional valve is controlled to become a closed state.

7. The combustion device according to claim 2, wherein the control portion performs the second determination process by using a second predetermined range as the normal range while an opening degree of the gas proportional valve is controlled to become a predetermined opening degree immediately before ignition of the combustor or in an initial stage of the ignition of the combustor.

8. The combustion device according to claim 2, wherein:

the control portion is constituted by a plurality of microcontrollers that communicate with each other; and the terminals are respectively included in the microcontrollers.

* * * * *